United States Patent [19]

Hancock et al.

[11] Patent Number: 4,731,038

[45] Date of Patent: Mar. 15, 1988

[54] PREFORMED CORE AND MOLDED PRODUCT AND METHOD OF MANUFACTURE

[76] Inventors: Kendal Hancock; Robert S. Scheurer, both of P.O. Box 539, Wichita Falls, Tex. 76307

[21] Appl. No.: 732,011

[22] Filed: May 1, 1985

[51] Int. Cl.[4] ..... B32B 31/14; A63C 15/00

[52] U.S. Cl. ..... 441/68; 280/610; 428/116

[58] Field of Search ..... 441/68; 280/610; 428/116

[56] References Cited

U.S. PATENT DOCUMENTS

| | | | |
|---|---|---|---|
| 3,201,138 | 8/1965 | Brown | 441/68 X |
| 3,740,301 | 6/1973 | Manning et al. | 441/68 X |
| 3,774,254 | 11/1973 | Meyer | 441/68 |
| 3,816,573 | 6/1974 | Hashimoto et al. | 280/610 X |
| 3,861,699 | 1/1975 | Molnar | 280/610 |
| 3,893,681 | 7/1975 | Manning et al. | 280/610 |
| 3,894,745 | 7/1975 | Heim et al. | 280/610 |
| 3,928,106 | 12/1975 | Molnar | 280/610 X |
| 3,930,658 | 1/1976 | Howe et al. | 280/610 |
| 4,261,778 | 4/1981 | Albrigtsen et al. | 441/68 X |
| 4,386,982 | 6/1983 | Weinhaus | 441/68 X |

FOREIGN PATENT DOCUMENTS

| | | | |
|---|---|---|---|
| 3031498 | 4/1982 | Fed. Rep. of Germany | 441/68 |

*Primary Examiner*—Nancy A. B. Swisher

[57] ABSTRACT

A molded ski has a preformed core rigidly attached to an inner plate and to an outer deck plate. The strength and density of the core is distinct from the strength and density of the remaining ski body.

22 Claims, 19 Drawing Figures

FIG. 4A
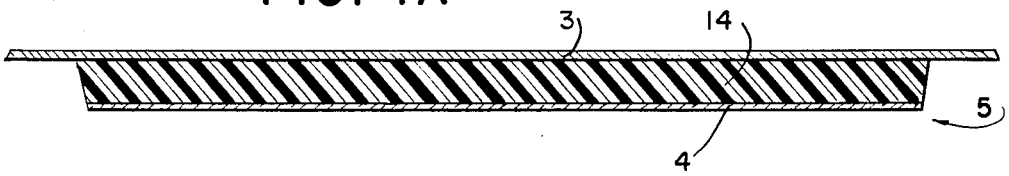
FIG. 4B
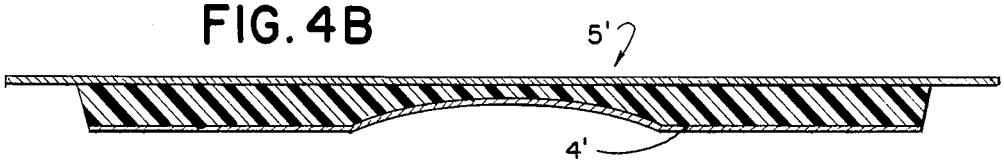
FIG. 4C
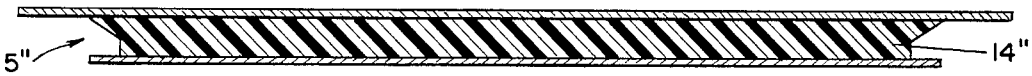
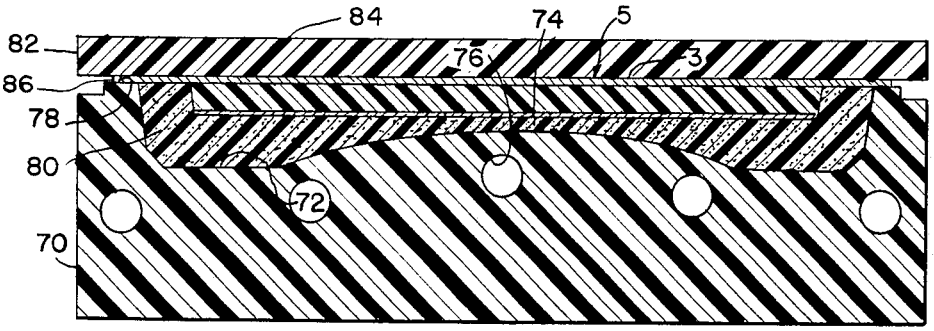
FIG. 6
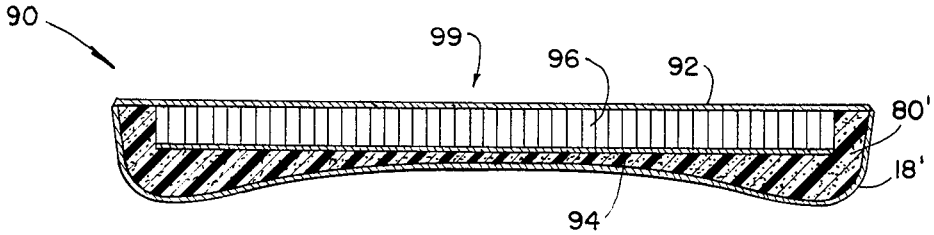
FIG. 7

PREFORMED CORE AND MOLDED PRODUCT AND METHOD OF MANUFACTURE

BACKGROUND OF THE INVENTION

This invention relates to strong, lightweight structures, particularly of composite materials and particularly structures which are used in sports. The invention particularly relates to structures having high aspect ratios with relatively long lengths as compared to thicknesses, relatively wide widths as compared to thicknesses and relatively narrow widths as compared to lengths. The invention particularly relates to structures used as occupant supporting vehicles which are self propelled or propelled by gravity. Notably the invention applies to water skis and skateboards in particular.

A need continues to exist for composite materials of substantial strength and rigidity and suitable for use in retaining basic shapes while being subjected to extreme forces.

In the example of skis, forces substantially greater than gravitational forces are encountered by linear and angular accelerations and surface irregularities. Shear and tortion forces at widely spaced positions must be accommodated without substantial distortions of the skis.

The present invention provides solutions to the problems with new and unobvious structures created by new and unobvious construction methods.

SUMMARY OF THE INVENTION

A molded ski has a preformed core rigidly attached to an inner plate and to an outer deck plate. The strength and density of the core is distinct from the strength and density of the remaining ski body.

The present invention provides new structures and methods of constructing composite materials and particularly water skis.

The present invention is particularly useful for producing reaction-injection molded materials and particularly water skis. Using the basic concept, a premolded foam or prefoamed honeycomb inner core extends inward in the structure from an outer deck. The outer deck is preferably made from an aluminum plate. Alternatively, the outer deck may be made from a plate of other material, such as a high strength metal or plastic or composite material.

The present invention eliminates any need for steel rods and positioning devices, as the suspended inner core structure automatically holds the inner reinforcement in place while molding the outer hull.

The present invention gives greater strength, variable lighter weight, and variable flex and rigidity in the inner core structure. The invention provides variable possibilities of weight and feel in the molded form outer hull. One embodiment of the present invention uses a highly desirable flexible foam outer hull and uses the inner suspended core structure for strength and rigidity.

One embodiment of the preferred water ski has a premolded foam/aluminum inner core structure. For example, water skis are constructed with a premolded foamed in place plastic core bonded in place on its top and bottom surfaces to upper and lower plates. One of the plates forms an outer surface of the ski. The premolded core which is bonded to and suspended from the outer deck is then placed in a finished ski mold. The mold is closed and the outer hull is then molded around and is bonded integrally to the inner premolded foam core structure and to the surfaces of the plates within the mold. The inner core structure runs substantially the entire length and width of the ski. The front and rear of the core structure are suitably curved upwardly to give the required rocker of the bow or shovel and tail of the ski.

By varying composition, density and/or thickness of plates and core structure, the weight and flex zone characteristics of the final product can be controlled.

By post molding the foamed outer hull separately, its characteristics can be varied to give the product several more desirable properties. For example, while relying upon the premolded inner core structure for strength, rigidity and flexibility, the outer hull may be molded of a flexible foam of a desired density. Thus, the finished product is given a highly unique set of superior properties, such as greatly improved durability, impact resistance, and flexible feel. This invention may be made using a standard rigid molded foam structure for the outer hull. The inner suspended structure gives increased strength and lightness. In the case of water skis, the increased lightness is translated into highly desirable increased buoyancy.

A preferred inner structure mold has vacuum means in the lower mold to hold one plate in place. The other plate extends outwardly from the mold. Preferably plates are bonded to honeycomb edges using heat and pressure.

The preferred honeycomb composite reinforced ski is similar in concept to the ski with the premolded foam inner core structure. The honeycomb composite ski uses a preformed honeycomb/aluminum core structure. The preferred honeycomb orientation is vertical and edges of the honeycomb structure are adhesive bonded with pressure and heat to inner surfaces of the composite plates. The prebonding is done in a heated press that requires no vacuum to hold the bottom and top aluminum plates in place.

Great strength, light weight and flexure control are advantages of the honeycomb/aluminum inner core structure. When bonded into the molded foam outer hull, the honeycomb core structure supplies strength and rigidity essential to the finished product.

The honeycomb core structure used in the molded foam outer hull provides the advantages of varying the properties of the molded outer foam hull, such as by using flexible foam if desired to present flexibility, durability, appearance and feel to the outer hull.

The preferred honeycomb is constructed of thin aluminum walls in vertical honeycomb arrangement. Other honeycomb walls of metal, plastic or composite materials may be used providing edges suitably bond to plates and providing requisite strength and lightness are supplied.

Trick skis constructed according to the present invention use premolded foam or preferably honeycomb aluminum suspended inner core structures.

Trick water skis constructed according to the present invention are preferably constructed with the strengthening member having upper and lower surfaces bonded to a lower surface of the outer deck and an upper surface of the inner plate, respectively.

In a preferred embodiment, the honeycomb structure is bonded to and suspended from the upper deck and the inner plate extends outwardly from the honeycomb structure to act as a stiffener and a reinforcement for the flexible extended edge of the trick ski. The core structure is placed in the finished ski mold with the outer deck being drawn tightly against inner surfaces of the mold. The mold is closed and the outer hull is then molded around and integrally bonded to the inner core structure and to the inner plate and to surfaces of the outer plate exposed within the mold structure. The inner core structure runs substantially the entire length and width of the ski.

By varying the thickness of the inner core structure, the weight and flex zone characteristics of the final product can be controlled.

By using a flexible foam in molding the outer hull, highly desirable characteristics of durability, impact resistance and feel can be obtained. The flexible foam edge eliminates problems of edge breakage on trick skis with the desirable top radiused edge design.

On previous trick skis, the soft edge feature could be achieved only by post bonding an extruded rubber bumper to the edge of the ski. The present invention eliminates all of the apparent problems inherent in the post bonded bumper, such as bond failure and weather cracking. In addition, the present invention may be used to provide an all soft foam exterior wherein all areas of the hull except the aluminum top are made of flexible foam. That is done by relying entirely upon the inner suspended core structure for strength and rigidity. The suspended inner core structure of the present invention may be used with a rigid foam outer hull in a variation of the invention.

When providing a trick ski with an aluminum deck plate and a wider, longer inner plate connected to a premolded inner core structure, the deck plate is first placed in the mold and is held tightly against the surface of the mold, such as by vacuum. The inner plate is then placed over the mold and is held tightly against the mold surface. Inner surfaces or entire surfaces of the deck plate and inner plate are prepared before placing in or on the mold. After the mold is closed, reaction material is injected into the mold and the material foams and expands, tightly bonding to the prepared surfaces of the plates.

By varying density or thickness of the foam in the suspended inner core structure, weight and flex zone characteristics of the final product are controlled.

In a preferred embodiment of the premolded inner core structure for use with trick skis, the deck plate and the inner plate both extend outward beyond the molded foam. A split ring mold is required in that configuration for molding the premolded foam inner core. No special vacuum means is necessary in that configuration as the plates are pressed tightly against outer surfaces of the split ring mold while the core foam is injected.

A preferred ski apparatus of the present invention includes deck means, strengthening means connected to a lower surface of the deck means for strengthening the ski apparatus, an inner surface means connected to the strengthening means remote from the deck means for cooperating with the strengthening means to strengthen the ski apparatus and ski body means connected to the deck means for enclosing the strengthening means and the inner surface means and for forming the ski body. Preferably the ski body is foam plastic material. In a preferred embodiment the ski body means comprises reaction-injected molded material.

A preferred deck means is a plate. One preferred strengthening means is a relatively rigid foam body having an upper surface connected to a lower surface of the plate. Preferably, the inner surface means is an inner plate having an upper surface connected to a lower surface of the relatively rigid foam body. The preferred ski body is a relatively less rigid foam body surrounding the strengthening foam body and the inner plate. The ski body forms side walls and a bottom wall of the ski. In one embodiment the inner plate is narrower than the deck plate, and the strengthening body has side walls which slope downward and inward from the deck plate to the inner plate.

Preferably, the deck plate and the inner plate are resilient plates. The preferred strengthening body comprises a structure which is relatively less dense, and the ski body comprises a foam structure which is relatively more dense than the strengthening body.

In one embodiment the inner plate comprises a plate having a longitudinally extending central upward curved section.

In one embodiment the upper and lower plates extend laterally outward beyond the strengthening body, and the strengthening body has an outer wall, at least part of which is sloped with respect to the upper and lower plates. In one embodiment the inner plate extends outward beyond an outward extension of the deck plate.

In the preferred ski apparatus the strengthening means is a vertically oriented honeycomb structure having honeycomb edges at upper and lower surfaces thereof. The upper surface of the vertical honeycomb structure is bonded to a lower surface of the deck plate, and a lower surface of the honeycomb structure is bonded to an upper surface of the inner plate. In one preferred embodiment, the deck plate extends outward beyond the upper surface of the honeycomb structure, and the inner plate extends to outer edges of the lower surface of the honeycomb structure.

In another preferred embodiment the inner plate extends beyond outer extensions of the upper plate, and both inner and outer plates extend outward beyond the honeycomb structure.

A preferred ski apparatus has a honeycomb structure having vertically oriented honeycomb walls and upper and lower surfaces. A first plate is bonded to the upper surface of the honeycomb structure, and a second plate is bonded to the lower surface of the honeycomb structure. A ski body encloses the honeycomb structure and at least a part of the first and second plates.

The preferred ski body comprises a polyurethane foam structure. The first plate forms a deck of the ski apparatus and the deck extends to outer lateral edges of the ski apparatus. In one embodiment outer extensions of the first plate extend outward beyond outer extensions of the second plate. In that embodiment the ski body extends generally outward and downward from the deck.

In one other embodiment the second plate extends generally outward beyond outer extensions of the first plate. In that ski the deck and the second plate extend generally horizontally outward beyond horizontal outward extensions of the honeycomb strengthening structure.

A preferred structural composite of the present invention includes first and second generally parallel plates and strengthening means interconnecting the first and second plates for holding the first and second plates in fixed spatial relationship and for resisting relative movement between the first and second plates. A body surrounds the strengthening means between the plates and encloses at least one of the plates. The first plate forms a surface of the structural composite. In one embodiment the body means extends outward and downward from the first plate.

Preferably the strengthening means has density which differs from density of the body. In a preferred embodiment the strengthening means is a vertical honeycomb structure having upper and lower honeycomb edges respectively bonded to a lower side of the first plate and to an upper side of the second plate.

In one preferred structural composite, the strengthening means comprises a relatively rigid low density foam and the body comprises a relatively flexible high density foam.

In the preferred structural composite, the first plate, which forms a surface of the structural composite, is used for mounting attachments on the structural composite.

In one structural composite human foot attachment means is connected to the first plate.

In one structural composite skate wheel truck attachment means is connected to the strengthener for forming a skateboard from the structural composite.

A preferred method of making a structure comprises attaching first and second generally parallel plates respectively to upper and lower surfaces of a strengthening member. The first plate is held at the outer surface of a mold and the mold surrounds the second plate and the strengthening member. Reaction-molding material injected into the mold forms a body of material around the strengthening member and second plate and against surfaces of the first plate exposed within the mold.

One preferred attaching step includes placing one plate in the bottom of a second mold, placing the other plate on top of the second mold, holding the one plate against the bottom of the second mold and holding the other plate against the top of the second mold and filling the second mold with reaction-injected molding material and adhering the molding material to inward facing surfaces of the plates, thus creating a strengthening member.

These and other objects and features of the invention are apparent in the disclosure which is the above and ongoing specification, including the claims, and the drawings.

BRIEF DESCRIPTION OF THE DRAWING

FIG. 4A is a cross-section of a preformed inner core of FIG. 1.

FIG. 4B is another embodiment of the preformed inner core structure.

FIG. 4C is another embodiment of the preformed inner core structure for use in a trick ski.

FIG. 6 is a cross-section of the mold used to construct the final finished ski of FIG. 1.

FIG. 7 is a cross-section of a ski with a honeycomb core.

DESCRIPTION OF THE PREFERRED EMBODIMENT

Figure 1:
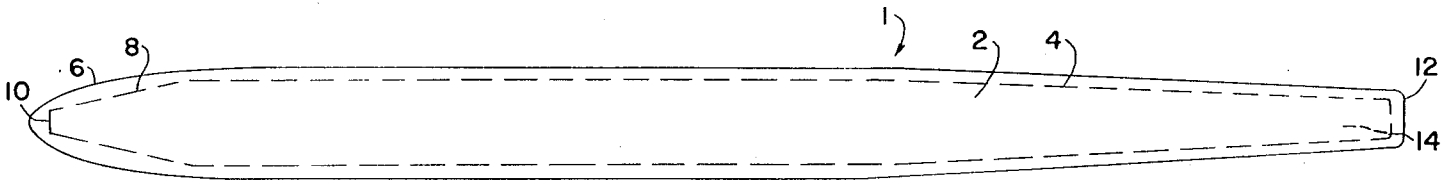
FIG. 1 is a plan view of a water ski having a preformed inner core structure.
Figure 2:
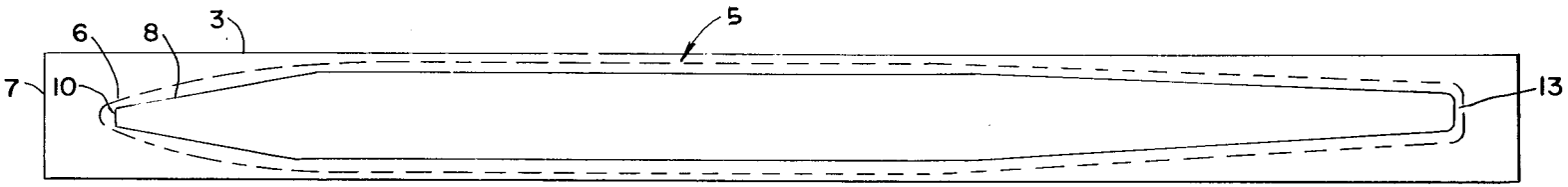
FIG. 2 is a bottom view of a water ski preformed inner core structure prior to the final finish.

Referring to FIG. 1, the water ski is designated 1. The dotted line 4 refers to the inner strengthening means fixed to the deck plate 2. The deck plate 2, extends beyond the inner-strengthening core 4. Deck plate 2 has a curved bow 6 which is similar in shape to the top of a ski. Inner plate 4 has sloped edges 8 and a blunt end 10. Tail 12 of the deck plate extends beyond end 13 of plate 4. As shown in FIG. 2, edges 7 of the deck plate blank 3 extend beyond the dashed finished line during intermediate steps in manufacture.

Figure 3:
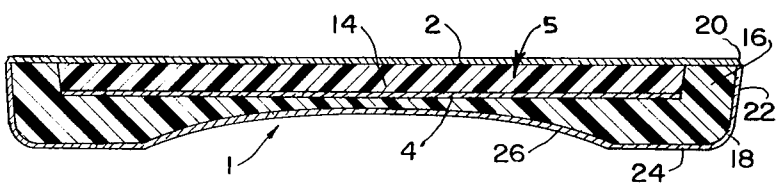
FIG. 3 is a cross-section of the ski of FIG. 1.

FIG. 3 shows a cross-section of the finished ski of FIG. 1. Upper plate 2 is referred to as the deck plate and may be made of aluminum or reinforced composite material. The sides 20 of plate 2 have been trimmed even with the self skin 18 of sides 22 of the polyurethane foam ski body 16. Inner core 5 is sometimes referred to as the strengthening means. The foam 14 is preferred to be less dense and more rigid than the foam body 16 which is preferred to be more dense and more flexible. The water ski 1 is shown having the bottom surface 24 curving toward the inner plate 4 to form a tunnel 26. It is preferred that the top or deck plate be aluminum or reinforced plastic material, such as a fiberglass reinforced epoxy resin sheet. The inner or lower plate may consist of aluminum, fiberglass, graphite and Kevlar reinforced sheet or titanium plate, or a premolded three piece sandwich inner plate may be used as an inner plate. The three piece member would be two parallel fiberglass graphite composite sheets sandwiched together with a rigid epoxy.

An aluminum plate may be used for the deck plate and fiberglass reinforced resin may be used for the inner plate. Either the fiberglass reinforced resin sheet or the aluminum sheet may be used for both inner and outer or deck plates. The inner core structure 5' in FIG. 4B is available for tunnel bottom models. In this case, the post-molded outer hull can be a more uniform coating over the inner core. It is preferred the outer hull be 3/16 inches thick where it covers the inner core except at corners 18 on FIG. 3 where more foam is needed. The post-molded outer foam may be rigid or more flexible foam.

FIGS. 4A, 4B, 4C present alternate embodiments of this inner strengthening core 5 in cross-section. Deck plate blank 3 preferably constructed out of aluminum extends beyond the foam structure 14 and inner plate 4. Deck plate blank 3 and inner plate 4 are generally parallel. Foam structure 14 is a relatively rigid, low density foam plastic. The deck plate 3, foam structure 14 and inner plate 4 comprise the strengthening means. The foam structure and inner plate 4' in core 5' shown in FIG. 4B have a central tunnel form. Core 5" has recessed foam 14" in FIG. 4C.

Figure 5:
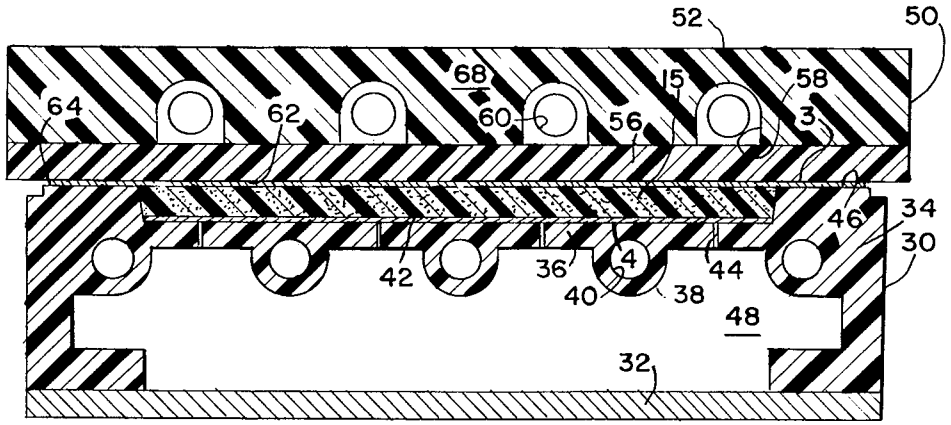
FIG. 5 is a cross-section of a mold used to form the inner core structures of FIG. 4A.

The mold for making a strengthening structure is shown in FIG. 5. The lower plate 42 which becomes inner plate 41 is placed in the bottom half 30 of the mold above mold structure 36. Deck plate blank 3 is placed on the top 46 of the bottom mold half 30, which rests on platen 32. Side walls 34 and projections 38 contain temperature control tubes 40. The inner plate 42 is held against the bottom 36 by a vacuum in chamber 48 communicated through openings 44. The vacuum urges the inner plate downward. Top mold half 50 has an upper portion 52 having chambers 50 with heat control tubes 60 and a rigid platen 56. Underside 62 presses downward on deck plate blank 3. Edges 64 of blank 3 extend beyond the final ski area. Tubes 60 control heat in mold body 68. Mold space 15 is then filled with reaction injected molding material. The material adheres to the inward facing surfaces of the plates.

Referring now to FIG. 6, the mold for construction the final product, as represented in cross-section has lower half 70 and upper half 82. Core 5 is placed on the upper surface 78 of the bottom half 70 as shown. Essentially, inner core 5 is suspended over mold chamber with wide side sections 72 and tunnel section 74. Deck plate blank 3 of inner core 5 rests on the upper face 78 of bottom half 70 by the deck plate edges 86. Upper half 82 is placed on inner core 5 holding the inner core secure. Pressure is applied on upper surface 84. The mold cavity is filled with reaction injected molding material which forms the ski body 80. Heat controlling fluid is flowed through tubes 76.

It is preferred the inner core have a structure which is relatively less dense and more rigid than the foam material surrounding the inner core forming the ski body.

Figure 8:
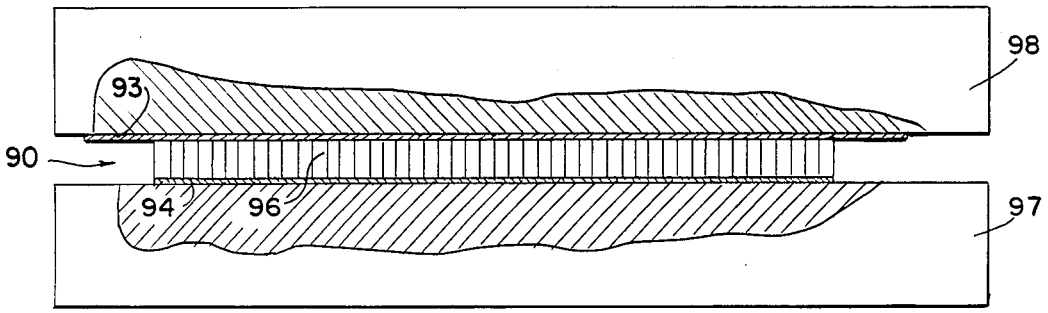
FIG. 8 is a cross-section of the apparatus used to form the honeycomb inner core structure.

A preferred ski 90 shown in FIG. 7 has a honeycomb inner core 99. The inner core for the ski which consists of plates 92 and 94 and honeycomb 96 is constructed with the apparatus of FIG. 8, shown in cross-section. Numeral 98 represents a bottom heated platen upon which is placed plate 94, which is a reinforced resin or aluminum. On top of plate 94 is placed vertically oriented honeycomb structure 96, which has honeycomb edges at the upper and lower surfaces. On top of the honeycomb structure 96 is placed deck plate blank 93 and on top of that, is placed heated platen 98. The device is a heated press which effects pressure bonding of the honeycomb to the plates. The upper surface of the vertical honeycomb is bonded to the lower surface of the deck plate. The lower surface of the honeycomb is bonded to the upper surface of the inner plate. The honeycomb reinforcement may be bonded to the platen with aircraft type film adhesives on upper and lower surfaces which are cured under heat and pressure in the press.

Figure 9:
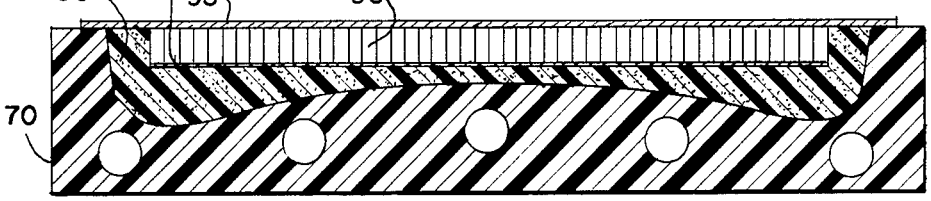
FIG. 9 is a cross-section of the mold used to form the ski with the honeycomb core structure of FIG. 2.
Figure 10:
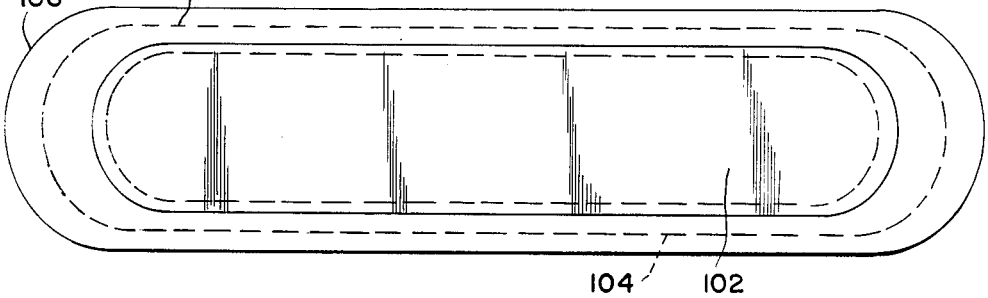
FIG. 10 is a plan view of a trick ski.

FIG. 9 shows a lower mold for forming the ski body. The deck plate 93, honeycomb structure 96 and inner plate 94 comprises the honeycomb core structure. The core structure is suspended over the mold cavity by resting deck plate 93 on mold 70 as shown. The deck plate is held against the mold 70 with an upper platen, not shown. The mold chamber is filled with reaction injected molding material which forms the ski body 80' around the inner core. The ski has an inner core of honeycomb material which is less dense and more rigid than the ski body or outer hull. The honeycomb inner core structure supplies strength and rigidity to the finished ski. The finished ski with the honeycomb core has great strength, light weight, and controls flexure. The molded outer foam hull may be varied such as using a flexible foam to present flexibility, superiour durability, appearance and feel. Deck plate blank 93 is trimmed and beveled. The body forms a self skin.

The finished ski 90 having the honeycomb inner core is shown in cross-section in FIG. 7. The trimmed and beveled deck plate 92, the vertically oriented honeycomb structure 96, and the inner or lower plate 94 comprise the premolded strengthening means. Ski body 80', which is relatively more dense and less rigid than the honeycomb structure, surrounds the strengthening core and inner plate and forms the sides and bottoms of the ski. Ski body 80' has a self skin or a finish coating 18'.

Figure 11:
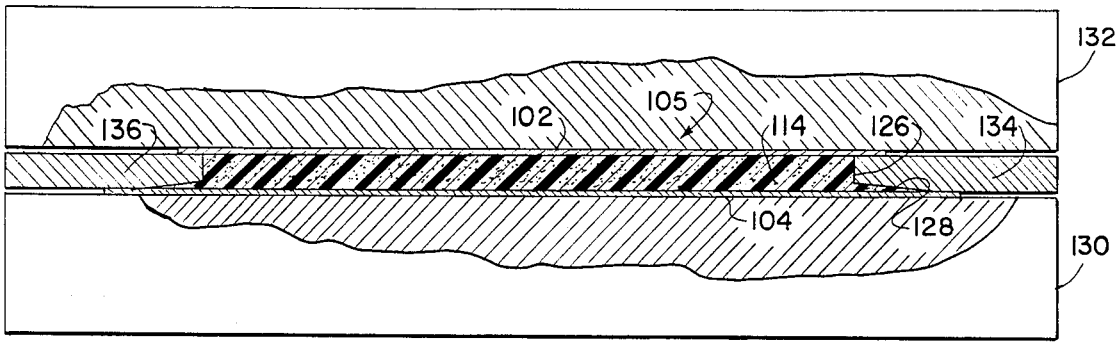
FIG. 11 is a cross-section of a split ring mold used to form the inner core structure of FIG. 4C for the ski of FIG. 10.

FIG. 11 shows the split ring mold needed for constructing the strengthening embodiment of FIG. 4C. It should be noted that vacuum means are not needed. The inner core structure, 4C is preferably used in trick skis. Looking at FIG. 4C, deck plate 3" does not extend beyond the boundary of inner plate 4". This is different from the inner cores of FIGS. 4A and 4B where the deck plate does extend beyond the inner plate.

Referring to FIG. 11, the mold had a lower platen 130, split ring mold 136, 134 and upper platen 132. Inner plate 104 is placed on bottom platen 130. Split ring mold 136, 134 is placed on inner plate 104. Deck plate 102 is placed on the split ring mold and held down by upper platen 132 placed thereupon. Inner mold surface 126 provides a perpendicular plane depending from the deck plate to a point short of the inner plate where the mold surface slopes precipitiously outward towards the inner plate 128. This helps to facilitate the release of the split mold. The mold chamber 114 is then filled with reaction injected molding material which adheres to the inner faces of the inner and deck plates.

Figure 12:
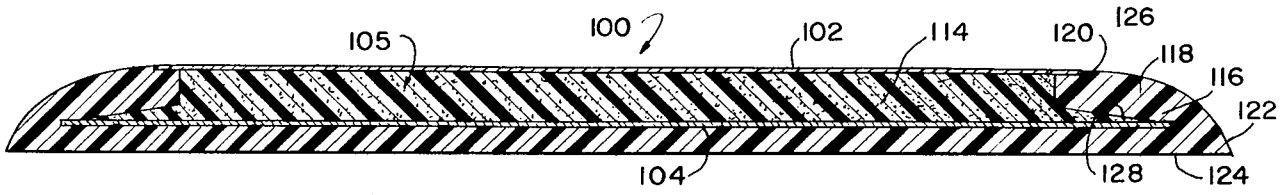
FIG. 12 is a cross-section of a trick ski of FIG. 10, showing the inner core structure of FIG. 4C.
Figure 13:
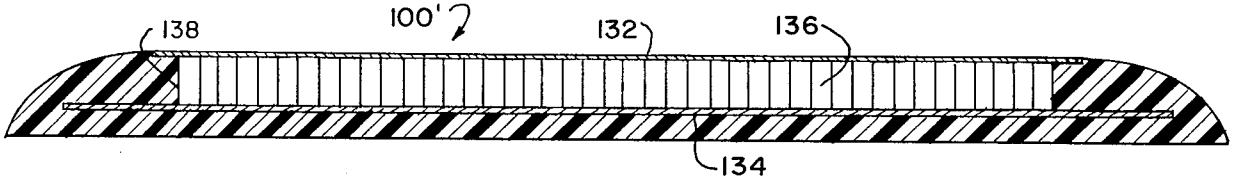
FIG. 13 is a cross-section of a trick ski having the honeycomb inner core.
Figure 14:
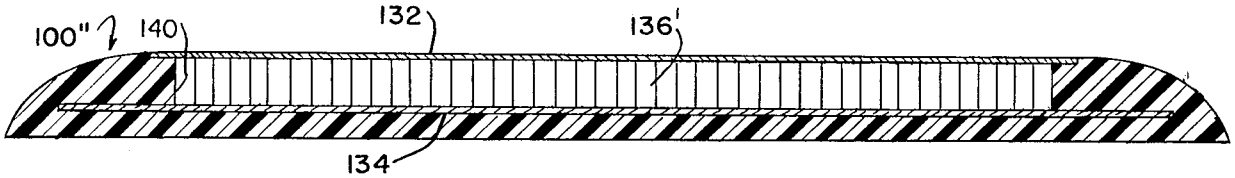
FIG. 14 is a cross-section of another trick ski.

FIGS. 12, 13 and 14 present cross-sections of trick skis. The ski of FIG. 12 incorporates the inner core 105 of FIG. 4C where the inner plate 104 extends out beyond the foam core body 114, as does the upper deck plate 102. This structure acts as a stiffener and reinforcement for ski body 120 and extended edge 122. The premolded inner core structure runs substantially the entire length and width of all the skis of the present invention. Deck plate 102, inner foam core 114 and lower or inner plate 104 form the strengthening core 105. The density and thickness of this inner core can be varied to effect the weight and flex-zone characteristics of the final product.

There is a slight angle 128 to the inner foam which helps to facilitate the special split ring mold release. The outer post-molded hull 116 is of a foam having the desirable characteristics of flexibility, durability, impact resistance and feel. The flexible foam edge 120, 118, 122 and 124 eliminates the problem of edge breakage on trick skis especially with the top radiused edge design 120, 118, 122. On all previous trick skis of this design, the soft edge feature could only be achieved by post-bonding an extruded rubber bumper to the edge of the ski. The invention eliminates all of the apparent problems inherent in the post-bonded bumper, such as bond failure and weather cracking. In addition, this is the first ski to exhibit an all soft foam exterior wherein all areas of the ski except the aluminum top and inner plate are made of flexible foam, which can only be done by relying entirely on the inner core structure for strength and rigidity. It should not be forgotten that there is also the option of using a rigid foam outer hull as a variation of the invention, but this is not considered as desirable as the flexible foam for trick skis.

The trick skis 100' and 100'' may also incorporate the aluminum honeycomb inner core as shown in FIGS. 13 and 14. FIG. 14 differs from FIG. 13 in the honeycomb 136 and 136'' between structure the deck plate 132 and center plate 134. The latter honeycomb structure 136' is filled with rigid foam for added strength.

Figure 15:
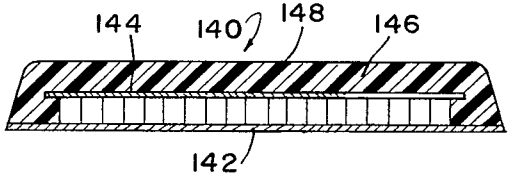
FIG. 15 is a cross-section of a skate board.

FIG. 15 shows the structure of a preferred skate board. The skate board is similar to a trick ski type composite, but is upside down.

Rigid foam may form the outer hull 146. The upper deck 148 is preferred to be rigid for supporting the human body. The bottom plate 142, preferably made of aluminum or a more rigid support material, the foam core and inner plate 144 comprise the strengthening means. Wheel assemblies are then attached to plate 142 to provide a skate board.

In one embodiment bolts are embedded in the strengthening means to attach wheel assemblies. In another embodiment elongated tubular nuts are embedded to provide subsequent attaching of wheel assemblies.

Figure 16:
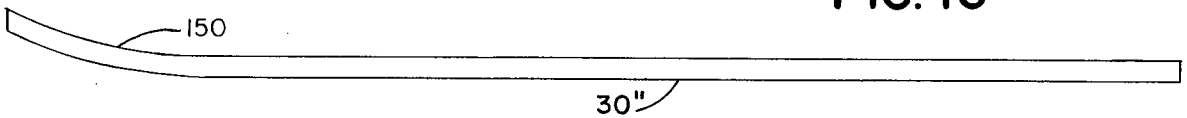
FIG. 16 is a side view of a finished ski showing typical dimensions.

FIG. 16 is a side view of the skis comprising the invention. The ski bottom 30'' is curved upward at opposite ends and the front end slopes up to form a shovel at 150'. The shovel may be reinforced by an inner core and plate that follows the curvature. Of course, this is just one example of the infinite shapes available.

Figure 17:
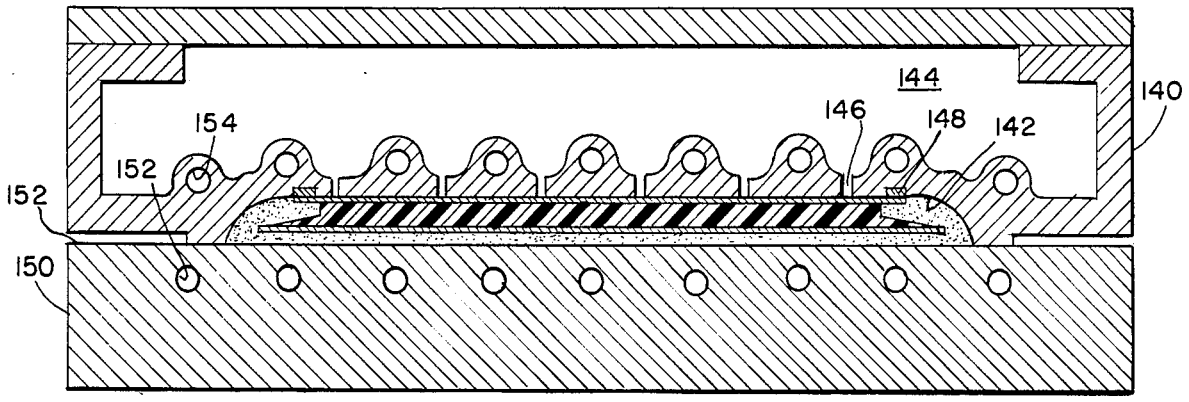
FIG. 17 is a cross-section of a mold used to make the trick ski of FIG. 12.

As shown in FIG. 17 a trick ski is made in a mold 140 having an upward or downward opening cavity 142 as shown. Vacuum chamber 144 communicates through openings 146 to hold the preformed deck plate and reinforcing structure against gasket 148. The mold is closed by a platen 150 having a surface 152, which controls the shape of the ski bottom. Tubes 152 and 154 circulate a medium to control temperature. The skis of the present invention may be made with methods and in molds which are similar to those described in U.S. Pat. No. 4,486,368. The outer or deck plate may be made of ⅛ inch aluminum. The inner plate or both plates may be made of unidirection (longitudinal) fiberglass and fiberglass cloth reinforced epoxy resin sanded on inner surfaces. Sheet adhesives attach inner surfaces to ⅛ inch cell alimunum honeycomb.

Having described the best mode of our invention, we now set out the spirit and scope of our invention with the following claims.

We claim:

1. Ski apparatus comprising deck means, strengthening means connected to a lower surface of the deck means for strengthening the ski apparatus, an inner surface means connected to the strengthening means remote from the deck means for cooperating with the strengthening means and strengthening the ski apparatus, ski body means connected to the deck means for enclosing the strengthening means and the inner surface means and for forming the ski body, wherein the strengthening means has a difficult strength and density than the ski body means.

2. The ski apparatus of claim 1 wherein the ski body means comprises foam plastic material.

3. The ski apparatus of claim 1 wherein the ski body means comprises reaction-injected molded material.

4. The ski apparatus of claim 1 wherein the deck means comprises a plate and wherein the strengthening means comprises a relatively rigid foam body having an upper surface connected to a lower surface of the plate and wherein the inner surface means comprises an inner plate having an upper surface connected to a lower surface of the relatively rigid foam body and wherein the ski body comprises a relatively less rigid foam body surrounding the strengthening foam body and the inner plate, the ski body means forming side walls and a bottom wall of the ski.

5. The ski apparatus of claim 4 wherein the inner plate is narrower than the deck plate and wherein the strengthening body has side walls which slope downward and inward from the deck plate to the inner plate.

6. The ski apparatus of claim 4 wherein the deck plate and the inner plate are thin plates.

7. The ski apparatus of claim 4 wherein the strengthening body comprises a foam structure which is relatively less dense and wherein the ski body comprises a foam structure which is relatively more dense than the strengthening body.

8. The ski apparatus of claim 4 wherein the inner plate comprises a plate having a longitudinally extending central upward curved section.

9. The ski apparatus of claim 4 wherein the upper and lower plates extend laterally outward beyond the strengthening body and wherein the strengthening body has an outer wall, at least part of which is sloped with respect to the upper and lower plates.

10. The ski apparatus of claim 4 wherein the inner plate extends outward beyond an outward extension of the deck plate.

11. The ski apparatus of claim 1 wherein the strengthening means comprises a vertically oriented honeycomb structure having honeycomb edges at upper and lower surfaces thereof and wherein the upper surface of the vertical honeycomb structure is bonded to a lower surface of the deck plate and wherein a lower surface of the honeycomb structure is bonded to an upper surface of the inner plate.

12. The ski apparatus of claim 11 wherein the deck plate extends outward beyond the upper surface of the honeycomb structure and wherein the inner plate extends to outer edges of the lower surface of the honeycomb structure.

13. The ski apparatus of claim 11 wherein the inner plate extends beyond outer extensions of the upper plate and wherein both inner and outer plates extend outward beyond the honeycomb structure.

14. Ski apparatus comprising a honeycomb structure having vertically oriented honeycomb walls and having an upper and lower surface, a first plate means bonded to the upper surface of the honeycomb structure and a second plate means bonded to the lower surface of the honeycomb structure and ski body means enclosing the honeycomb structure and at least a part of the first and second plates.

15. The ski apparatus of claim 14 wherein the ski body comprises a foam structure.

16. The ski apparatus of claim 15 wherein the ski body comprises a polyurethane foam structure.

17. The ski apparatus of claim 16 wherein the first plate forms a deck of the ski apparatus.

18. The ski apparatus of claim 17 wherein the deck extends to outer lateral edges of the ski apparatus.

19. The ski apparatus of claim 18 wherein outer extensions of the first plate extend outward beyond outer extensions of the second plate.

20. The ski apparatus of claim 17 wherein the ski body extends generally outward and downward from the deck.

21. The ski apparatus of claim 18 wherein the second plate extends generally outward beyond outer extensions of the first plate.

22. The ski apparatus of claim 21 wherein the deck and the second plate extend generally horizontally outward beyond horizontal outward extensions of the honeycomb strengthening structure.

* * * * *